United States Patent [19]

Zimmermann et al.

[11] 4,105,264

[45] Aug. 8, 1978

[54] PROCESSING ROLLER HAVING REINFORCING JACKET OF HARD METAL

[75] Inventors: Heinz Zimmermann; Wolfgang Martens, both of Krefeld, Fed. Rep. of Germany

[73] Assignees: Günther Hertel, Nüremberg; Karl Gustav Hertel, Fürth, both of Fed. Rep. of Germany

[21] Appl. No.: 791,299

[22] Filed: Apr. 27, 1977

[30] Foreign Application Priority Data

Apr. 29, 1976 [DE] Fed. Rep. of Germany ..... 2618884

[51] Int. Cl.[2] ..... F16C 13/00

[52] U.S. Cl. ..... 308/20; 29/121.6

[58] Field of Search ..... 308/20, DIG. 11, DIG. 7, 308/DIG. 8, 238; 193/35 R, 37; 198/780; 29/121.6, 132, 123, 125; 72/236

[56] References Cited

U.S. PATENT DOCUMENTS

| | | | |
|---|---|---|---|
| 1,289,602 | 12/1918 | Baehr | 29/121.6 |
| 3,577,619 | 5/1971 | Strandel | 29/132 X |
| 3,902,233 | 9/1975 | Ohtsu | 29/125 |

FOREIGN PATENT DOCUMENTS

| | | | |
|---|---|---|---|
| 1,427,871 | 3/1969 | Fed. Rep. of Germany | 29/123 |
| 714,914 | 9/1954 | United Kingdom | 29/123 |

*Primary Examiner*—Trygve M. Blix
*Assistant Examiner*—Douglas C. Butler
*Attorney, Agent, or Firm*—Spencer & Kaye

[57] ABSTRACT

Hot working roller reinforced with a working jacket of hard metal or the like, the jacket being prestressed in the direction of the roller axis by a clamping force acting via clamping rings presenting clamping surfaces inclined with respect to the roller axis, with the jacket being separated from the roller body by an annular gap having a height such that during use of the roller the outer surface of the roller body remains out of contact with the inner surface of the jacket over the entire intended operating temperature range of the roller.

9 Claims, 4 Drawing Figures

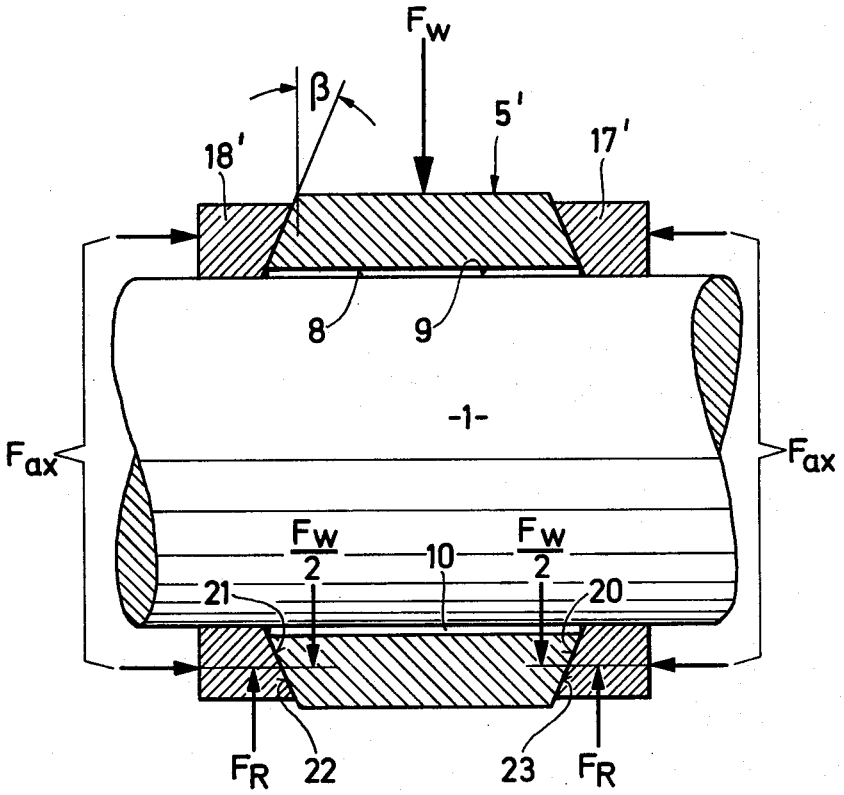
Fig. 3
Fig. 4
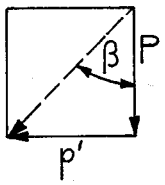

PROCESSING ROLLER HAVING REINFORCING JACKET OF HARD METAL

BACKGROUND OF THE INVENTION

The present invention relates to a roller, particularly a hot roller, which is reinforced with a working jacket of a hard metal or the like, and particularly a roller in which the working jacket is prestressed by a compression pressure applied in the direction of the longitudinal axis of the roller via clamping rings which have clamping surfaces that are arranged at an angle with respect to the roller body.

In the case of many types of rollers, particularly hot profile rollers, there has been in recent times a demand for structures capable of supporting ever higher specific surface stresses. As a result, the use of rollers made of conventional materials, i.e. steel or heat resisting steel and the like has become more and more uneconomical.

To overcome this drawback, such rollers have been given surface reinforcements which are capable of withstanding greater stresses, in particular hard metal reinforcements. In special cases the hard metal can be replaced by special heat resistant alloys, sintered metals or other suitable materials.

Such reinforced rollers are disclosed, for example, in German Offenlegungsschrift [Laid-Open Application] No. 1,427,871. They include a roller core of steel or the like onto which is placed a roller body of a hard metal, hard-cast, or the like material which is clamped in between suitable abutments or clamping rings to maintain a permanent pressing force acting in the direction of the longitudinal axis. With such an arrangement the roller body is protected against wear, breaks and the like, and serves substantially to transfer the rotating moment to the working jacket. In such an arrangement, the roller pressure is transferred to the roller body, which is made to be elastic to the extent that it is capable of absorbing bending stresses. According to a particular embodiment, the clamping surfaces of the device are inclined toward the roller core so that the pressure force has a centripetal component directed toward the roller core.

Reinforced rollers of this type are satisfactory in practice if the prevailing operating temperatures do not get too high. At higher operating temperatures they have the drawback that the radial stress exerted by the roller body on the working jacket can cause the latter to burst. The reason for this is that the coefficients of linear thermal expansion of the steels usable for this purpose are approximately three times greater than the coefficients of linear thermal expansion of the conventional hard metals. As a basis for discussion, it can be assumed that the coefficient of linear thermal expansion of steel is about $13\text{–}18 \cdot 10^{-6} \cdot \text{degree}^{-1}$ and that of hard metal about $5\text{–}7{\cdot}5 \cdot 10^{-6} \cdot \text{degree}^{-1}$. Unfortunately there is the added fact that hard metal is capable of absorbing extraordinarily high friction and pressure stresses but, as a result of its relatively soft cobalt matrix, is less able to withstand tensile stresses.

SUMMARY OF THE INVENTION

It is a primary object of the present invention to overcome or minimize the drawbacks of prior art rollers of this type.

A more specific object of the invention is to provide a roller, particularly a heat resistant roller, which is reinforced with hard metal and which can be used as well at higher operating temperatures without raising the danger of crack formation in the working jacket.

These and other objects are achieved according to the present invention by providing a continuous annular gap between the working jacket and the roller body and giving the gap a sufficiently great height that during operation of the roller over its operating temperature range the outer jacket surface of the roller body and the inner jacket surface of the working jacket do not come into contact with one another.

The precise dimensions of the annular gap depend, on the one hand, on the increase in temperature which is to be expected and, on the other hand, on the coefficients of linear thermal expansion of the materials employed. The condition is met if the ratio of the diameter (D) of the inner jacket surface of the working jacket to the diameter (*d*) of the outer jacket surface of the roller body correspond to the relationship $$\frac{D}{d} > \Delta\theta_{max} \cdot (\alpha_1 - \alpha_3)$$

where $\Delta\theta_{max}$ = the maximum increase in temperature during operation;

$\alpha_1$ = the coefficient of linear thermal expansion of the roller body and $\alpha_3$ = the coefficient of linear thermal expansion of the working jacket.

In embodiments of the reinforced roller according to the invention, the working jacket made of hard metal or the like does not directly contact the roller body. Rather, it is held in a floating manner by suitable clamping elements through the intermediary of further clamping rings. Care must be taken, however, when constructing such a roller that the clamping rings rest directly on the roller body and consequently participate in the expansion movement of the roller body when heated. Consequently, there exists the danger, in principle, that with increasing temperatures the seat of the working jacket may come loose so that the jacket, in the end, does come to rest on the roller body. To prevent this, it is proposed, in further accordance with the invention, to provide at least one spring elastic member between the working jacket and the abutment and to give the member a spring displacement path which is sufficient to advance the clamping ring in correspondence with the expansion due to heat. In principle the spring elastic member may here include springs of any desired type; preferred are embodiments in which the member is a disc spring or a packet of disc springs. It is also possible, however, for the member to be a plastic ring or a ring packing filled with plastic. The spring elastic member must be dimensioned so that the spring displacement path (*f*) satisfies the following condition:

$$f > \Delta\theta_{max} \cdot [\alpha_1 \cdot l_3 - \alpha_2(l_1 + l_2) + \tan\beta \cdot D_m(\alpha_2 - \alpha_3) - B_{wm} \cdot \alpha_3]$$

where $\Delta\theta_{max}$ = the maximum temperature increase during operation of the roller;

$\alpha_1$ = the coefficient of linear thermal expansion of the roller body;

$\alpha_2$ = the coefficient of linear thermal expansion of the clamping rings;

$\alpha_3$ = the coefficient of linear thermal expansion of the working jacket;

$l_1 + l_2$ = the total axial dimension of the clamping device, including the clamping rings;

$l_3$ = the axial length dimension of the roller body;

$\beta$ = the angle of inclination of the clamping surfaces to a plane perpendicular to the roller axis;

$D_m$ = the median diameter of the clamping surfaces; and $B_{wm}$ = the median axial dimension of the working jacket.

In addition to the spring path of the elastic member, the contact pressure ($F_{ax}$) acting in the direction of the longitudinal axis is also of interest for the structure of the proposed roller, which contact pressure must be transmitted by the clamping device or the spring elastic members, respectively, to the working jacket. The dimensioning of the corresponding parts may be determined in that the force ($F_{ax}$) meets the following requirement:

$$F_{ax} \geqq \frac{F_w}{2\,[\tan(\beta - \zeta_2) - \tan \zeta_1]}$$

where $F_w$ = the centripetally acting force exerted by the workpiece;

$\beta$ = the angle of inclination of the clamping surfaces;

$\zeta_1$ = the friction angle between steel and steel, with $\tan \zeta_1 = \mu_{01}$, the coefficient of friction between steel and steel;

$\zeta_2$ = the friction angle between steel and hard metal, with $\tan\zeta_2 = \mu_{02}$, the coefficient of friction between steel and hard metal.

BRIEF DESCRIPTION OF THE DRAWINGS

FIG. 3 is a simplified pictorial, longitudinal view, partly in cross section, of an embodiment of a roller according to the invention, illustrating the dimensioning rule for the contact pressure acting in the direction of the longitudinal axis.

FIG. 4 is a vector diagram showing the relationship of the rolling force P to the reaction, or absorbing, force $p'$ which has a component in the direction of the longitudinal axis.

DESCRIPTION OF THE PREFERRED EMBODIMENTS

Figure 1:
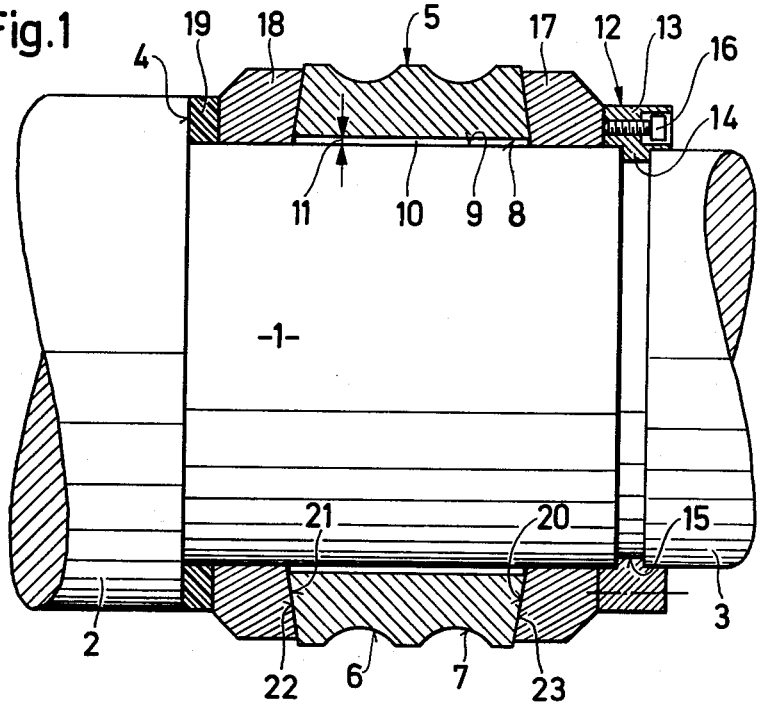
FIG. 1 is a longitudinal view, partly in cross section, of a hot roller reinforced with hard metal and having two juxtaposed working profiles, according to one embodiment of the invention.

FIG. 1 illustrates a roller which includes a roller body 1 provided at its ends with bearing and drive journals 2 and 3. In the illustrated embodiment, journal 2 has a larger diameter than roller body 1 so that a shoulder 4 is created at the point of transition.

Roller body 1 is reinforced with a working jacket 5 of hard metal, heat resistant steel, a sintered material or the like. In the embodiment shown in FIG. 1, this working jacket has two roller profiles 6, 7 which, however are of no significance for the invention.

The working jacket 5 is dimensioned to provide a continuous annular gap 10 between its inner peripheral surface 8 and the outer peripheral surface 9 of the roller body 1. The height 11 of this annular gap is at least large enough that during operation of the roller the outer surface 9 of roller body 1 and the inner surface 8 of working jacket 5 will not come into contact with one another.

In order to keep the working jacket 5 in the illustrated position, it is necessary to place it under compression in the direction of the longitudinal axis. This is done with the aid of a pressing, or clamping, device 12 which in the illustrated embodiment is a screw press composed of an annular housing 13 provided with a foot 14 which engages into an annular groove 15 disposed between roller body 1 and journal 3. A plurality of clamping screws 16 are arranged in annular housing 13 and distributed around its circumference to be tightened from the outside. In this way it is possible to produce an easily adjustable pressure acting on the working jacket 5 via clamping disc 17 in the direction of the roller longitudinal axis. It must be pointed out, however, that the structural details of this clamping device are of no significance insofar as concerns the contribution of the invention and any other suitable clamping devices can be used as well.

The working jacket 5 is pressed, under the influence of the pressure force acting on it, against another clamping disc 18, which in turn is pressed against an elastically resilient member 19 which is illustrated in FIG. 1 as a plastic ring or a plastic filled packing ring. The member 19, which is of great advantage for the proper operation of the device but is not absolutely necessary, is itself supported on the shoulder 4 disposed at journal 2.

FIG. 1 shows that the clamping surfaces 20 and 21 of clamping discs 17 and 18 are inclined toward the roller core. The clamping surfaces 22 and 23 of the working jacket 5 are inclined in a corresponding manner so that they are flush against surfaces 20 and 21. The inclination causes a centripetal component to be branched off from the pressure force acting in the direction of the longitudinal axis on the working jacket 5 so that the working jacket 5 is held in its illustrated position even when subjected to the rolling pressure.

The direction of the inclination of the clamping surfaces also assures that tensile components developed as a result of the stress are compensated and only compressive components remain active in the working jacket. The load on the working jacket 5 at the top of FIG. 1 will be diverted round the journal 2. At the bottom of FIG. 1 the journal rests on the clamping discs 17 and 18 which take over the load and transmit it to the members 19 and 12, 13. Hence all parts mentioned will only be compressively, and not tensionally, loaded. In order to ensure that no bending takes place the pressure loaded by way of device 12, 13 must be great enough that in all cases there remains a positive value of pressure strength in each member, especially jacket 5.

The height 11 of annular gap 10 must be greater than the amount by which roller body 1 expands when heated. This is accomplished, referring to FIG. 2, if the relationship of D to $d$ meets the condition.

$$\frac{D}{d} > \Delta\theta_{max} \cdot (\alpha_1 - \alpha_3)$$

where $\Delta\theta_{max}$ = the maximum increase in temperature during operation;

$\alpha_1$ = the coefficient of thermal expansion of the roller body;

$\alpha_3$ = the coefficient of thermal expansion of the working jacket.

Figure 2:
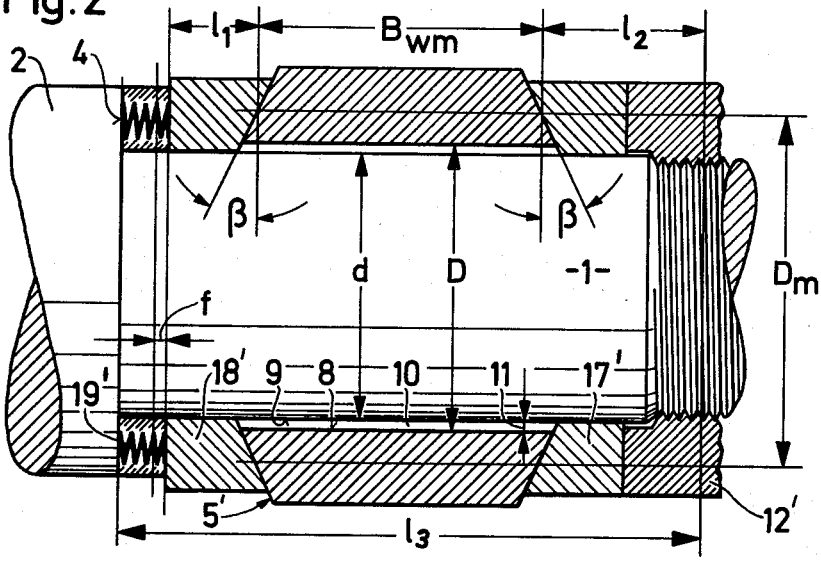
FIG. 2 is a view similar to that of FIG. 1 of a similarly designed roller, illustrating the dimensioning rules for the height of the annular gap for the length of the spring displacement path according to the invention.

FIG. 2 also shows that when roller body 1 expands in a radial direction it carries the clamping rings 17' and 18' along. In order to compensate the thus reduced pressure force the spring displacement path (*f*) of member 19' illustrated in FIG. 2 as a disc spring packet, must meet the condition $$f > \Delta\theta_{max} \cdot [\alpha_1 \cdot l_3 - \alpha_2(l_1+l_2) + \tan\beta \cdot D_m(\alpha_2\alpha_3) - B_{wm} \cdot \alpha_3]$$

The individual terms of this relationship are shown in FIG. 2. Individually they are:

$\alpha_1$ = the coefficient of linear thermal expansion of roller body 1 (diameter *d;* length $l_3$);

$\alpha_2$ = the coefficient of linear thermal expansion of clamping discs 17' and 18' (combined length $l_1 + l_2$);

$\alpha_3$ = the coefficient of linear thermal expansion of working jacket 5' (inner diameter D; median width $B_m$);

$\beta$ = angle of inclination of the clamping surfaces relative to a plane normal to the roller axis.

FIG. 3 shows that the clamping device or the spring-elastic member, neither of which is illustrated there, must transmit a contact force $F_{ax}$ acting in the direction of the longitudinal axis on the working jacket 5' which satisfies the condition:

$$F_{ax} \geqq \frac{F_w}{2\,[\tan(\beta - \zeta_2) - \tan\zeta_1]}$$

The individual members of this condition are shown in FIG. 3; individually they indicate:

$F_w$ = the force applied by the workpiece in a plane containing the roller axis and in the direction toward the roller axis;

$\beta$ = the angle of inclination of the clamping surfaces;

$\zeta_1$ = the friction angle between steel and steel ($\tan\zeta_1 = \mu_{01}$);

$\zeta_2$ = the friction angle between steel and hard metal ($\tan\zeta_2 = \mu_{02}$).

FIG. 4 shows in a schematic manner the relation between the compensating force p', along the horizontal coordinate axis, and the rolling force P, along the vertical coordinate axis in arrangements according to the invention.

The "hard metal" employed for the working jacket of rollers according to the invention can be constituted by any suitable one of the known hard metal cemented carbides. It may be used especially sintered hard metals with cobalt matrix and hard carbides such as Wolfram carbide, Titanium carbide, Tantalum carbide or Niobium carbide.

It will be understood that the above description of the present invention is susceptible to various modifications, changes and adaptations, and the same are intended to be comprehended within the meaning and range of equivalents of the appended claims.

What is claimed is:

1. In a roller for working material, which roller includes a rotatably mounted roller body, a reinforcing working jacket having the form of a hollow cylinder disposed around the roller body, clamping means mounted between the roller body and the jacket and including claming rings presenting surfaces which bear against the axial end surfaces of the jacket for applying an axial compressive prestress force to the jacket, the axial end surfaces of the jacket and the clamping ring surfaces which bear thereagainst being inclined with respect to the roller axis, the improvement wherein said roller body and working jacket define an annular gap between the inner peripheral surface of said working jacket and the outer peripheral surface of said roller body, the dimension of said annular gap in the direction between said jacket and roller body being sufficiently large to maintain the outer peripheral surface of said roller body and the inner peripheral surface of said working jacket out of contact with one another during operation of said roller at temperatures extending over its entire operating temperature range, and said roller comprises means defining a radially-extending abutment surface fixed relative to said roller body and axially spaced from one of said clamping rings, and resiliently deformable force transmitting means compressively held between said abutment surface and said one of said clamping rings.

2. An arrangement as defined in claim 1 wherein said roller is a hot roller.

3. An arrangement as defined in claim 2 wherein said jacket is composed of hard metal.

4. An arrangement as defined in claim 1 wherein the ratio of the diameter of the inner peripheral surface of said working jacket to the diameter of the outer peripheral surface of said roller body is greater than:

$$\Delta\theta_{max} \cdot (\alpha_1 - \alpha_3),$$

where $\Delta\theta_{max}$ = the maximum increase in temperature during operation of said roller;

$\alpha_1$ = the coefficient of linear thermal expansion of said roller body; and $\alpha_3$ = the coefficient of linear thermal expansion of said working jacket.

5. An arrangement as defined in claim 1 wherein said force transmitting means comprise at least one disc spring.

6. An arrangement as defined in claim 1 wherein said force transmitting means is a plastic ring.

7. An arrangement as defined in claim 1 wherein said force transmitting means is a plastic filled packing ring.

8. An arrangement as defined in claim 1 wherein the axial length of said force transmitting means is resiliently variable by an amount greater than $$\Delta\theta_{max} \cdot [\alpha_1 \cdot l_3 - \alpha_2(l_1+l_2) + \tan\beta \cdot D_m(\alpha_2 - \alpha_3) - B_{wm} \cdot \alpha_3]$$

where $\Delta\theta_{max}$ = the maximum temperature increase during operation of said roller;

$\alpha_1$ = the coefficient of linear thermal expansion of said roller body;

$\alpha_2$ = the coefficient of linear thermal expansion of said clamping rings;

$\alpha_3$ = the coefficient of linear thermal expansions of said working jacket;

$l_1 + l_2$ = the combined axial lengths of said clamping means; $l_3$ = the axial length of said roller body;

$\beta$ = the angle of inclination of each said jacket axial end surface and each said clamping ring surface bearing thereagainst, relative to a plane perpendicular to the axis of said roller;

$D_m$ = the median diameter of the area of contact between said jacket axial end surfaces and said clamping ring surfaces bearing thereagainst; and $B_{wm}$ = the median axial length of said working jacket.

9. An arrangement as defined in claim 1 wherein said roller body and clamping rings are made of steel, said working jacket is of a hard metal, and the axial compressive force applied by said clamping means to said jacket is at least eqaul to:

$$\frac{F_w}{2\,[\tan(\beta - \zeta_2) - \tan \zeta_1]}$$

where $F_w$ = the force exerted on said jacket by a workpiece in the direction of a radius of said roller;

$\beta$ = the angle of inclination of each said jacket end surface and each said clamping ring surface bearing thereagainst, relative to a plane perpendicular to the axis of said roller;

$\zeta_1$ = the friction angle between said roller body and said clamping rings; and $\zeta_2$ = the friction angle between said clamping rings and said jacket.

* * * * *